US006817666B1

(12) United States Patent
Blount

(10) Patent No.: US 6,817,666 B1
(45) Date of Patent: Nov. 16, 2004

(54) ROCKER PROTECTING SLEEVE

(76) Inventor: Mary Blount, 428 SW. 8th St., Gainesville, FL (US) 32601

( * ) Notice: Subject to any disclaimer, the term of this patent is extended or adjusted under 35 U.S.C. 154(b) by 0 days.

(21) Appl. No.: 10/434,104

(22) Filed: May 9, 2003

(51) Int. Cl.[7] ..... A47C 3/02; A47C 15/00

(52) U.S. Cl. ..... 297/272.2; 297/272.1; 297/272.4; 297/463.2

(58) Field of Search ..... 297/272.1, 272.2, 297/272.4, 463.2; 248/345.1; 5/105

(56) References Cited

U.S. PATENT DOCUMENTS 720,788 A * 2/1903 Davenport ..... 297/272.2
793,946 A * 7/1905 Miller ..... 297/272.2
1,252,418 A * 1/1918 Fitz ..... 297/272.2
1,618,646 A * 2/1927 Fisher ..... 297/272.2
2,054,487 A * 9/1936 Simpson ..... 297/272.2
3,669,490 A * 6/1972 Bertolet ..... 297/272.2
5,564,782 A * 10/1996 LaGrange et al. ..... 297/272.4
2003/0024558 A1 * 2/2003 Lewis ..... 135/72

* cited by examiner

*Primary Examiner*—Peter M. Cuomo
*Assistant Examiner*—Sarah C. Burnham
(74) *Attorney, Agent, or Firm*—Sven W. Hanson

(57) ABSTRACT

The present invention is rocking chair rocker cover consisting of an elongated pocket-shaped sleeve that fits snugglely over the entire length of a rocker. The cover has an elongated opening to allow the cover to the fitting onto, and easily removed from, a rocker. In use, the opening is drawn closed over the top of a rocker by closure devices such as elastic cord secured to the opening perimeter and cross ties. The covering material may consist of woven fabric such as readily available quilting, providing a means of easily adding to the aesthetic appeal of the device. To increase protection from contact injury, the cover includes cushioning such as foam rubber or polyester fiber fill captured on or within a flexible covering material. In some embodiments a nonskid element is positioned under the rocker bearing surface to increase friction of the rocker against a floor surface in use.

13 Claims, 3 Drawing Sheets

ROCKER PROTECTING SLEEVE

BACKGROUND OF THE INVENTION

The present invention pertains to safety devices for protecting persons from injury due to contact with chairs. In particular, the present invention is a device for covering and cushioning the rockers of rocking chairs to prevent injury to small children from contact with the hard surfaces, edges and ends of rockers.

Many devices are available for protecting persons from the ends or bottom edges of rockers. However, these are typically unsightly and detract from the appearance of the chair. In addition, the prior art devices typically are too easily removed or require permanent installation with fastening methods that are detrimental to the appearance and value of the chair. No prior art device provides cushioning to lessen the effect of contact against all portions of the rocker element of rocking chairs.

SUMMARY OF THE INVENTION

The present invention is a rocker cover that provides simple and attractive ways of protecting adults and children from injury from contact with rocking chair rockers. The inventive rocker cover is an elongated pocket-shaped sleeve that fits snugglely over the entire length of a rocker. The cover has an elongated opening to allow the cover to fit onto, and be easily removed from, a rocker. In use, the opening is drawn closed over the top of a rocker by closure devices such as elastic cord secured to the opening perimeter and cross ties secured across opening and over the rocker top surface. The covering material may consist of woven fabric such as readily available quilting, providing a means of easily adding to the aesthestic appeal of the device.

To increase protection from contact injury, the cover includes cushioning such as foam rubber or polyester fiber fill captured on or within a flexible covering material. In use, the cushioning overlays the ends, sides and corners of a rocker received in the cover.

Additional advantage is obtained in some embodiments by use of a nonskid element positioned under the rocker bearing surface to increase friction of the rocker against a floor surface in use.

Additional characteristics and advantages of this novel invention are illustrated in the following drawings, detailed description, and claims.

DESCRIPTION OF THE PREFERRED EMBODIMENTS

Figure 1:
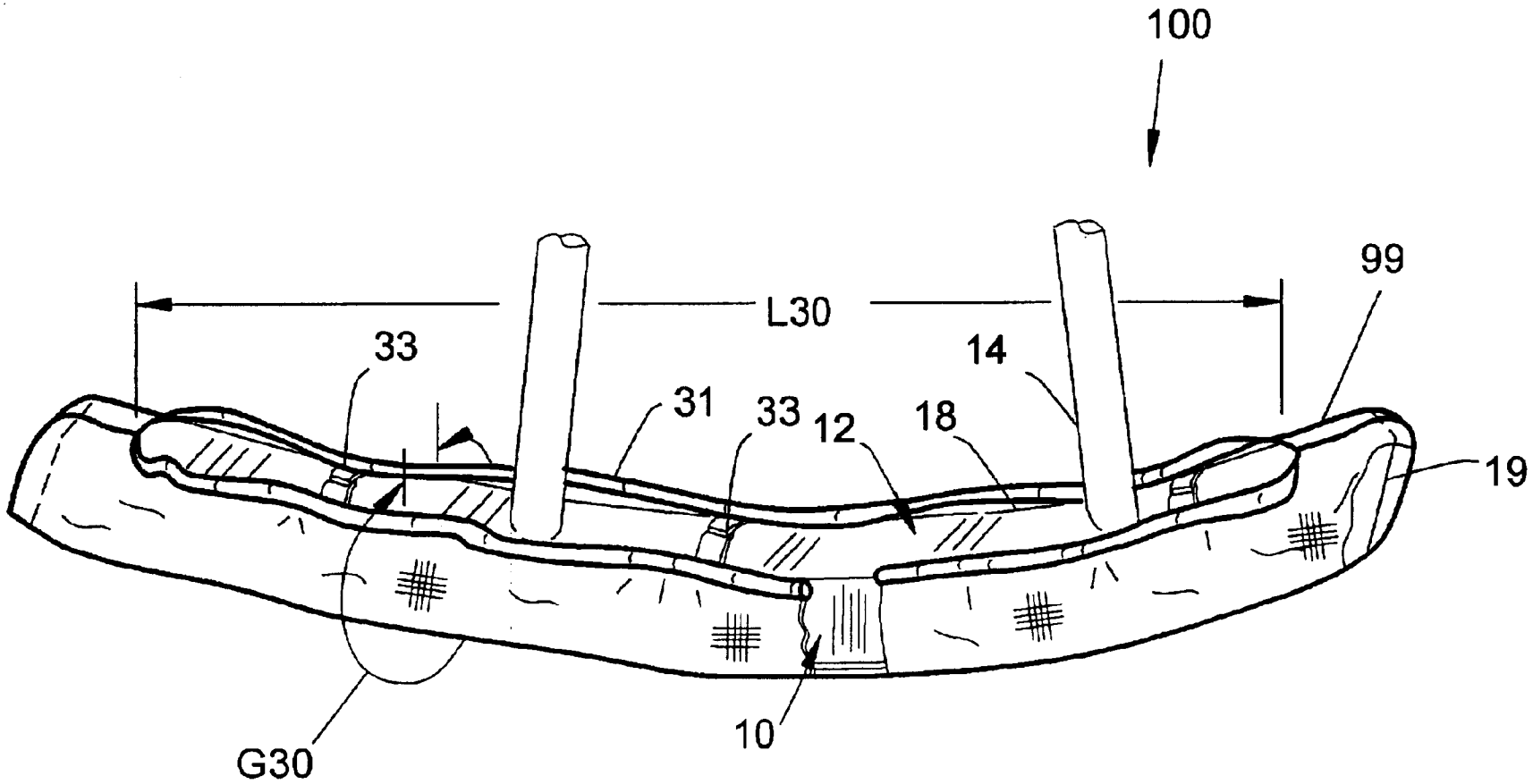
FIG. 1 is a perspective view of a rocker cover according to the present invention positioned on a typical rocker.
Figure 2:
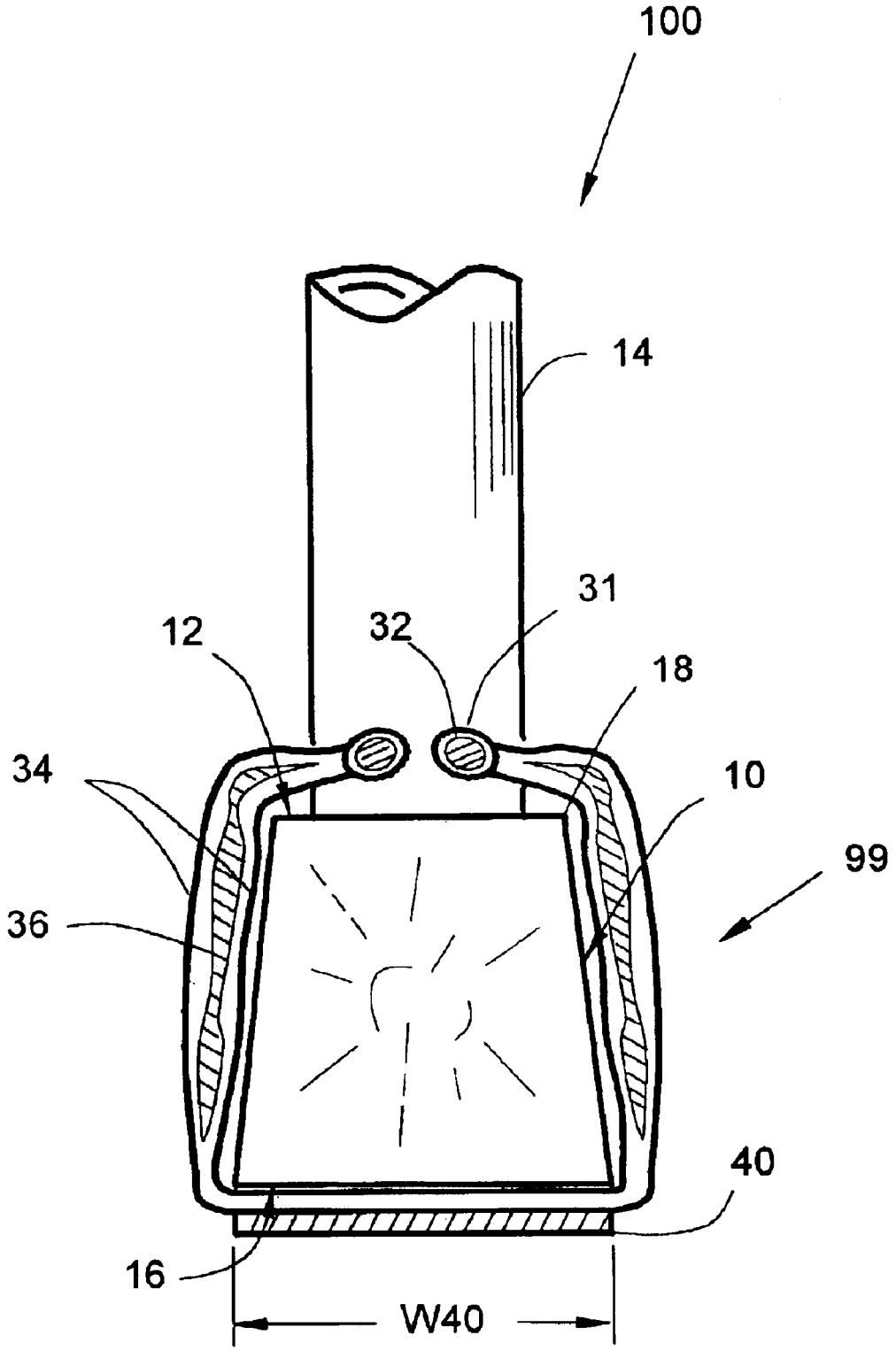
FIG. 2 is a cross-section view of the embodiment of FIG. 1.

FIG. 1 is a perspective view of a typical elongated rocker 100 of a rocking chair covered with a rocker cover 99 according to the present invention. FIG. 2 is a cross-section view of the same embodiment and the following discussion refers to elements shown in both illustrations. A typical rocker has elongated side surfaces 10 which are substantially vertical.

Their exact orientation is not critical, and the term "vertical" is used here only to distinguish from a rocker top surface 12 from which, typically, chair legs 14 extend. The intersections of the sides and top generally result in sharp or rounded edges 18. Generally on the side opposite the top surface 12 is an elongated bottom bearing surface 16, the longitudinal curve of which induces the "rocker" operation. The top and sides terminate at opposing ends 19 which often include additional edges and corners.

The inventive rocker cover 99 is formed of flexible sheet-like material which is configured to conform to the rocker in the shape of an elongated sleeve. The cover 99 includes an elongated longitudinal opening 31 defined by the terminal extent (open edge) of the sheet-like material. When fitted to a rocker, the opening 31 must be limited in width and length or biased toward a closed condition to ensure that the cover filly overlies the side surfaces 10 and edges 18, and substantially shields the top surface 12 from contact. At the same time, the opening 31 must be long enough to allow a typical rocker to be received within the cover.

Preferably, in a closed condition in which the opening is minimized or biased to minimized dimensions, the opening has a maximum length dimension L30 less than the maximum length of the cover, and of the rocker length. This is to ensure that the cover 99 is retained and does not slip over the ends 19 of the rocker. Typical rocker lengths are in the range of 33 to 40 inches. For these rockers, the closed condition length dimension is preferred in the range of 30 to 36 inches.

Various means of closing the opening are contemplated. In a preferred embodiment, the opening 31 includes an elastic cord 32 which, when elastically stretched to an open condition, provides an opening size allowing receipt of the rocker. Due to the combined natures of the elastic cord and the flexible sheet-like material, the opening may be closed and reduced in dimension and area by the elastic cord gathering or drawing in the sheet-like material. When released, the tension of the elastic cord closes the opening, or biases the opening toward a more closed condition. This action draws the fabric of the cover around the rocker and over the top surface 12 to at least partially cover it. Because the opening is elongated, the elastic cord 32 can provide only small biasing force laterally across the top surface except near the ends. Consequently, it is preferred that the closure means include one or more cross-ties 33. The cross-ties are one or two members secured to the opening at one point and capable of being removably secured to a second point of the opening; the second point being at a position to fall on the opposite side of the rocker when the cover is in place. The cross-ties may be pairs of cords to be tied, single cords with attachment devices such as buttons or hooks at a terminal end, pairs of fabric tabs with attachment devices such as buttons or hook-and-loop material. FIG. 1 illustrates cross-ties 33 consisting of pairs of fabric tabs each having a hook-and-loop connection made from material marketed under the trademark "Velcro" VELCRO® or similar hook-and-loop products. Other examples of cross-ties include elastic loops secured to one point of the opening and removably attached at an opposite point by a button or hook. Other cross-tie structures are also contemplated that serve the same function of removably securing or biasing the sides of the opening 31 to cover the top surface of the rocker when the cover is in place. The structure and function of the elastic cord 32 as a closure means may also be replaced by alternatives such as inelastic cord disposed in a sleeve at the opening and enabling the cord to be drawn tight within the sleeve to gather the sheet-like material and close the opening.

A primary function of the invention is to provide comfort to persons contacting the hard surfaces of a rocker. To this end, the sheet-like material is preferably a woven or knit fabric in combination with a soft cushioning structure. In the embodiment shown in FIGS. 1 and 2, the sheet-like material consists of two layers of woven fabric 34 with a cushion material 36 captured between. The woven fabric 34 is preferably a light weight polyester blend fabric such as is used for garments. The cushion material 36 is a mass of loose polyester fibers. One example construction is commercially available quilted fabric. Such fabric materials are easily cut and sewn in known manner to form the three-dimension sleeve shape shown that will receive and closely conform to a curved rocker. Such fabric and fiber constructions are also easily cleaned, which is desired. Alternative constructions providing similar cushioning and flexibility are contemplated and will be obvious to those skilled in the art. In FIG. 2 each woven fabric is shown as a one dimensional element extending from the top surface 12, around the rocker bottom, to the opposing side of the rocker at the top surface 12. It is important that the cushioning material 36 extend over the top of and around the rocker corners 18 to protect from this greatest source of injury to infants and children. Although no interconnection between the two fabric layers is shown, interconnection in the manner of quilting is preferred to stabilize the cushion material. Alternative sheet-like materials having the necessary flexibility and softness are contemplated.

In FIG. 2, a nonskid element 40 is shown on the cover in an orientation to reside beneath the bottom surface 16 of the rocker. The nonskid element is preferably symmetric on the cover, with the sheet-like material extending in equal lengths from both side edges of the nonskid element 40. The width W40 of the nonskid is preferable in the range of ¾ to 1.5 inches to provide effective bearing surface under typical rockers. The nonskid element also extends the full length of the rocker bearing surface 16. The non-skid element may take the form of a natural rubber or silicone-based rubber, or foam rubbers, or similar material deposited directly on the surface of the sheet-like material. Alternatively, this may be accomplished by application of available non-skid sheets having integral adhesive. The nonskid element may contain friction inducing elements such as imbedded sand or the like, although for use on valuable wood floors or other soft floors, a rough non-skid element may not be desired. To effectively cover the sides and top of a typical rocker, the sheet-like material preferably extends from each side of the non-skid element a height dimension of 2 to 3 inches to the cover opening 31. A total girth dimension G30 (FIG. 1) orthogonal to the length L30 in the range of 5.5 to 9 inches will cover most typical rockers. Dimensions greater than 9 inches are not desired as resulting in too loose a fit on even large rockers. In alternative constructions, the fabric 34 elements do not underlie the nonskid element, but rather initiate at, and extend from, the sides of a nonskid element.

Figure 3:
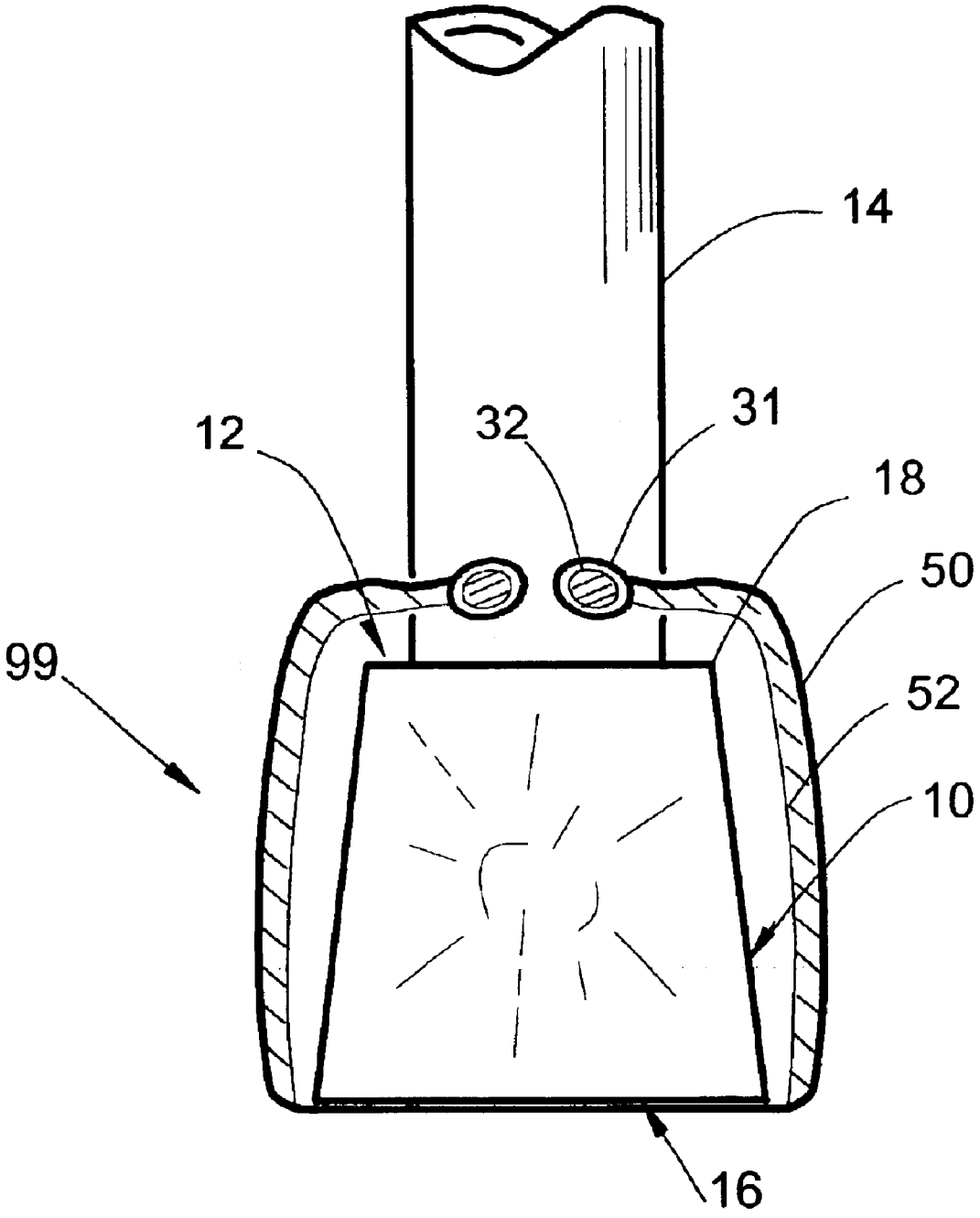
FIG. 3 is a cross-section view of a second embodiment of the invention showing an alternative cushioning structure.

FIG. 3 illustrates, in cross-section view, an alternative embodiment of the inventive rocker cover 99. The construction of the cover is as discussed with the following distinctions. The sheet-like material consists of a single layer of rubberized fabric 50 having a bonded internal cushion material 52. This bonded cushion material 52 consists of foam rubber or similar material that bears directly on the rocker without an internal fabric layer. This embodiment also illustrates a cover without a separate non-skid element. For use on many carpeted floors increased friction of a non-skid element may not be necessary and this option is contemplated in combination with the elements of other embodiments discussed.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A cushioned rocker cover for rocking chairs comprising:

an elongated fabric sleeve having an elastic cord loop defining a longitudinal opening configured to accept both ends of a rocker;

a non-skid surface disposed on an outside surface of the fabric sleeve and oriented to be retained against a bottom bearing surface of a rocker disposed within the sleeve; and the fabric sleeve having cushioning positioned and retained in a configuration to cover a rocker disposed within the fabric body.

2. A cushioned rocker cover for rocking chairs comprising:

an elongated non-skid surface;

a flexible fabric sheet extending from the non-skid surface and forming an elongated sleeve having a longitudinal opening for receiving both ends of a rocker;

the opening having a closure means for biasing the opening smaller;

the flexible fabric sheet having cushioning; such that the exposed surfaces of a rocker having a curved bearing surface is covered by cushioning when the rocker is received in the sleeve and the non-skid surface is adjacent the bearing surface.

3. A rocker cover according to claim 2, and wherein:

the opening has a length dimension in a first range of 30 to 36 inches.

4. A rocker cover according to claim 3, and wherein:

the non-skid surface has a width dimension orthogonal to the length dimension in a second range of ¾ to 1.5 inches.

5. A rocker cover according to claim 4, and wherein:

the sleeve has a girth dimension in a third range of 5.5 to 9 inches.

6. The rocket cover according to claim 2, and wherein:

the flexible fabric sheet is at least one layer of a washable woven fabric.

7. A rocker cover according to claim 6, and wherein:

the cushioning is loose polyester fibers.

8. A rocker cover according to claim 2, and wherein:

the flexible sheet is a quilted fabric containing the cushioning.

9. A rocker cover according to claim 2, and wherein:

the non-skid surface is a thin layer of rubber disposed on a bottom surface of the flexible sheet.

10. A rocker cover according to claim 2, and wherein:

the closure means comprises:

an elastic cord secured to the flexible sheet at the sleeve opening, and at least one pair of tie cords.

11. A cushioned rocker cover for rocking chairs rockers having substantially vertical sides, ends terminating the sides, and opposing top and bottom surfaces intersecting the sides at edges, the cover comprising:

a fabric elongated sleeve with a longitudinal opening configured to accept both ends of an elongated rocking chair rocker such that the sleeve covers the bottom, sides, ends, edges and top of the rocker; and closures for biasing the opening closed about the rocker.

12. The cover of claim 11, and further comprising:

a non-skid surface disposed on the sleeve and oriented to be retained proximate the bottom surface of a rocker disposed within the sleeve.

13. A cushioned rocker according to claim 12, and wherein:

the sleeve has contiguous cushioning positioned and retained in a configuration to bear against rocker sides, ends, and top surface of the rocker disposed within the sleeve.

* * * * *